United States Patent [19]

Brown

[11] Patent Number: 4,930,739

[45] Date of Patent: Jun. 5, 1990

[54] CABINET DRAWER GUIDE ATTACHMENT AND ADJUSTMENT ASSEMBLY

[75] Inventor: James L. Brown, Sellersburg, Ind.

[73] Assignee: Haas Cabinet Co., Inc.

[21] Appl. No.: 222,508

[22] Filed: Jul. 21, 1988

[51] Int. Cl.[5] ..... A47B 96/07

[52] U.S. Cl. ..... 248/220.2; 16/94 R; 248/251

[58] Field of Search ..... 29/453; 248/220.2, 221.4, 248/225.1, 251; 312/338; 16/94 R; 384/22

[56] References Cited

U.S. PATENT DOCUMENTS 3,149,811 9/1964 Fremstad et al. ..... 248/251

3,675,883 7/1972 Holmes et al. ..... 248/251

4,176,890 12/1979 Gorton ..... 248/251 X

*Primary Examiner*—Mark Rosenbaum

*Assistant Examiner*—Frances Chin

[57] ABSTRACT

A two-piece bracket assembly for use in cabinetry as a drawer slide rear mounting include one piece to receive the rear end of a drawer slide. The other piece is fastened to the inside of the cabinet back. The first piece is pushed into the second piece and retained by spring-clip detent action. Horizontal sliding movement of the clipped portion of the second piece in the first piece is possible when needed for adjustment of the slides to establish parallelism of the drawer front with the cabinet front, without adjustment of the piece fastened to the cabinet back.

6 Claims, 3 Drawing Sheets

CABINET DRAWER GUIDE ATTACHMENT AND ADJUSTMENT ASSEMBLY

BACKGROUND OF THE INVENTION

Various drawer guides are used in the cabinetry industry to allow sliding movement of drawers in and out of a cabinet. The drawer guides can be mounted over, under, or on the side of the drawer box. The drawer guides can be made of various materials, i.e. metal, wood or plastic. Drawer guides or slides can allow for partial or full extension of the drawer box from within the cabinet. A drawer slide typicallY consists of a guiding channel within which rollers mounted on the side of the drawer box are laterally retained, yet the rollers move freely along the channel. The rollers are attached to the case or drawer box using nails, screws or other attachment techniques.

In cabinetry wherein the side, front frame and rear walls are all interconnected forming a box or case, the drawer slide is normally attached to the front and the rear or back of the cabinet. The typical slide mounting procedure is to insert the drawer slide into a mating plastic or metal receptacle, and then attach the receptacle in some manner to the back of the cabinet. If the rear of the drawer slide has been attached to the cabinet back at the factory, a problem can arise thereafter during the installation of the cabinet if uneven or unsguare walls of the installation site pull the cabinet out of square. If the back or rear end of the drawer slide has no lateral movement or adjustment capability, then the drawer front will not properly fit flush against the front of the cabinet when the drawer is moved into the non-square cabinet along the drawer slides. If the rear mounting bracket for the drawer slide has no adjustment, or if the adjustments are made by removing screws or staples prior to relocating the bracket, then adjustments are cumbersome, difficult, and time consuming for the installer. Additionally, where a building foundation has settled and shifted from a relatively square configuration, misalignment of the cabinetry and adjoining drawer slides may also occur. If this occurs, adjustment of the drawer slides is necessitated by the circumstances and, typically, the adjustment will require removal of screws or loosening of screws or removal of staples in order to realign the drawer slides. An additional consideration is that wear and tear from heavy and repeated use of the drawer slides may require further adjustment or replacement.

Still a further difficulty with existing bracket assemblies for drawer slides involves the difficulty of installation, wherein the drawer slide attachment and the wall or cabinetry back bracket must be installed simultaneously. A drawer slide rear bracket which consists of two parts, a rear bracket and a slide end bracket installable separately and then matably connected without tools, would simplify installation and improve manufacturing processes by reducing labor costs in the cabinetry industry.

SUMMARY OF THE INVENTION

In a typical embodiment of the present invention a two-piece bracket assembly for use in cabinetry as a drawer slide rear mounting includes one piece to receive the rear end of a drawer slide. The other piece is fastened to the inside of the cabinet back. The first piece is pushed into the second piece and retained by spring-clip detent action. Horizontal sliding movement of the clipped portion of the second piece in the first piece is possible when needed for adjustment of the slides to establish parallelism of the drawer front with the cabinet front, without adjustment of the piece fastened to the cabinet back. The first piece may be a spring metal mounting bracket which has a rear surface adapted for mounting to the inside back wall of the cabinet, and an upper surface and a lower surface projecting from the rear surface toward the front of the cabinet. The upper and lower surfaces are vertically spaced a distance less than the diameter of a cylindrical plug portion of the second piece so the second piece is resiliently gripped tiqhtly in the first, but can be horizontally displaced to the extent needed for the adjustment desired.

A general object of the invention is to provide an improved bracket assembly for use in cabinetry as a drawer slide rear mounting bracket.

Another object is to provide a bracket assembly which allows for lateral adjustment of the drawer slides after installation of the slides and the bracket.

Another object of the invention is to provide for more economical installation of the bracket assembly during the manufacture of cabinetry.

A further object of the invention is to provide a simplified means for realignment of drawer boxes to cabinetry fronts once a cabinet assembly is installed in a room or building having unsquare mounting surfaces.

These and other objects and advantages of the invention will become more apparent upon reference to the following detailed description and accompanying drawings.

DESCRIPTION OF THE PREFERRED EMBODIMENT

Figure 1A:
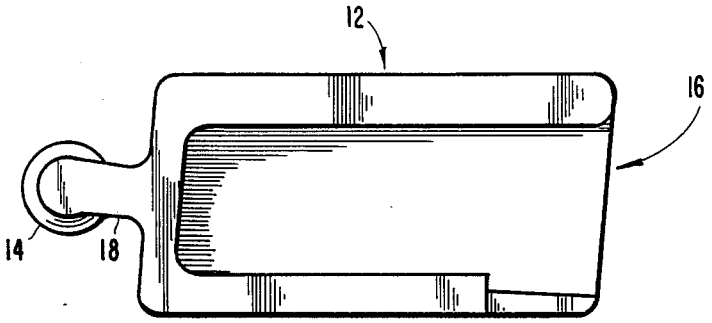
FIG. 1A is a side view of the drawer slide end bracket according to a typical embodiment of this invention.

For the purposes of promoting an understanding of the principles of the invention, reference will now be made to the embodiment illustrated in the drawings an specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A side view of drawer slide end bracket 12 according to a typical embodiment of this invention is shown in FIG. 1A. The bracket 12 consists of a cylindrical portion 14, a slide end receiving portion 16, and a central portion joining the cylindrical portion and the slide end receiving portion, the central portion being the interconnecting portion 18. The profile height of the interconnecting portion 18, shown in FIG. 1A, is less than the diameter of the cylindrical portion 14. The slide end receiving portion 16 is shown in one form designed to receive a particular style and design of drawer slide. It should be noted, however, that the slide end receiving portion 16 can be configured to receive a variety of commercially available drawer slides.

Figure 1C:
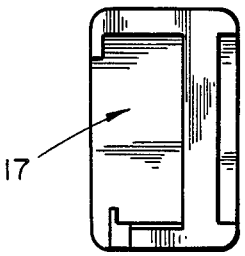
FIG. 1C is a front end view of the drawer. slide end bracket shown in FIG. 1A.
Figure 1B:
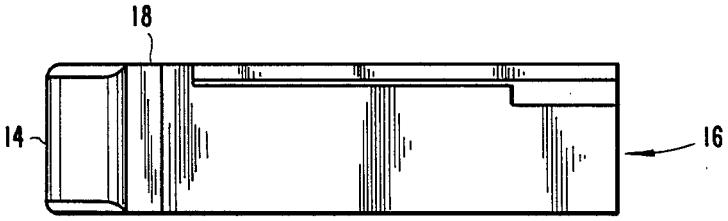
FIG. 1B is a bottom plan view of the drawer slide end bracket shown in FIG. 1A.

Referring now to FIG. 1B, the cylindrical portion 14 is shown attached along its entire length to the interconnecting portion 18. This provides for a maximum amount of support and structural strength between cylindrical portion 14 and drawer receiving portion 16.

Referring to FIG. 1C, a front end view of the slide receiving portion is shown. The channel 17 is sized and shaped to snugly fit a drawer slide as the slide is inserted into the slide end bracket. The slide end bracket is made from nylon, polyethylene, or other similar moldable, lightweight, strong materials.

Figure 2B:
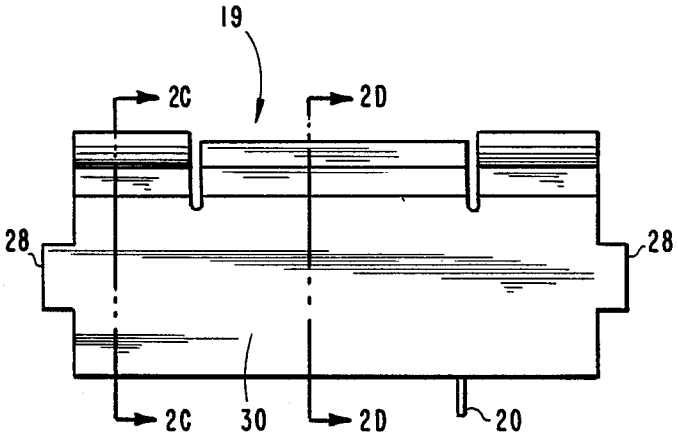
FIG. 2B is a bottom plan view of the mounting bracket shown in FIG. 2A.
Figure 2C:
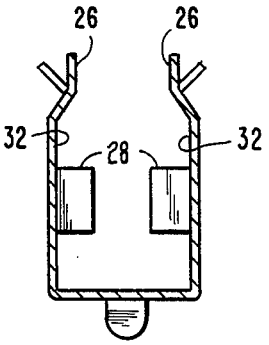
FIG. 2C is a cross sectional view looking in the direction of the arrows 2C—2C in FIG. 2B.
Figure 2A:
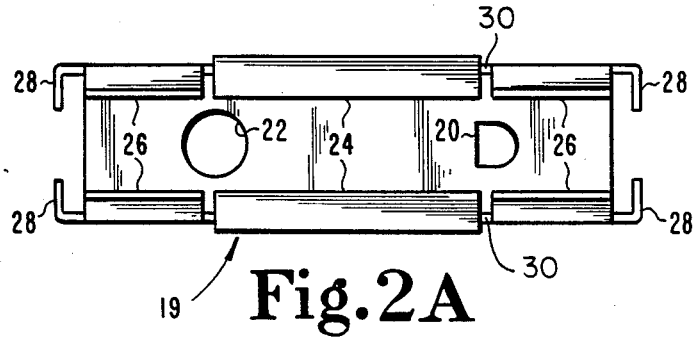
FIG. 2A is a front view of the rear mounting bracket of the typical embodiment of this present invention.

Referring to FIG. 2A, a front view of a mounting bracket 19 is shown. Bracket 19 would normally be made of spring steel of a thickness sufficient enough to support the anticipated weight of the drawer mounted to the drawer slide. The mounting bracket 19 is secured to a rear wall of the cabinetry by inserting tab 20 into a locating hole in the cabinet back and screwing a screw into hole 22 from the inside area of the cabinet or by installing a pop rivet drawn back through the front side of hole 22 and secured from the rear side of the cabinet, at the factory, The cylindrical portion 14 of the slide end bracket 12 is inserted between the detented portions 24 of the mounting bracket. The retaining portions 26 act to retain the cylindrical portion 14 of slide end bracket 12 in FIG. 1A from escaping the channel defined by the upper and lower retaining portions 26. End stops 28 prevent the cylindrical portion 14 of end bracket 12 of FIG. 1A from escaping the lateral ends of the mounting bracket during the adjustment of slide end bracket 12 of FIG. 1A between the end stops of the mounting bracket 19.

FIG. 2B shows a bottom view of mounting bracket 19. End stops 28 are once again visible, and their central location along the edge of the surface 30 further reveals their functionality in retaining the cylindrical portion 14 of slide end bracket 12 once portion 14 is inserted between the surfaces 30 of mounting bracket 19 in FIG. 2A.

FIG. 2C is a sectional view looking in the direction of the arrows 2C—2C in FIG. 2B. The distance between clamping surfaces 32 is dimensionally sized to be slightly smaller than the diameter of the cylindrical portion 14 of slide end bracket 12 in FIG. IA. The retaining portions 26 are also shown in FIG. 2C.

Figure 2D:
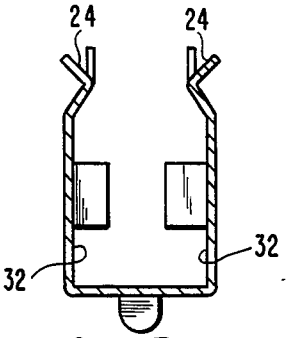
FIG. 2D is a cross sectional view looking in the direction of the arrows 2D—2D in FIG. 2B.

FIG. 2D is a sectional view looking in the direction of the arrows 2D—2D in FIG. 2B. The detented portions 24 taper out for receiving the cylindrical portion 14 of slide end bracket 12 in FIG. 1A. It should also be noted that the detented portions extend along the length of mounting bracket 19 in FIG. 2A for a distance slightly greater than the horizontal width of cylindrical portion 14 of end bracket 12 shown in FIG. 1B.

A typical installation procedure would include inserting the slide end receiving portion 16 of the slide end bracket 12 in FIG. 1A onto a drawer slide. Tab 20 of the mounting bracket 19 would be located in a hole in the rear wall 44 of the cabinet shown in FIG. 3A. Bracket 19 of FIG. 2A would be attached to the rear wall by a screw or pop-rivet inserted into hole 22 of FIG. 2A placed adjacent to the locating tab to assure horizontal mounting of the bracket. Once bracket 19 is mounted to a rear wall, the cylinder portion 14 of drawer slide end bracket 12, with the drawer slide mounted to it, is then inserted between the detenting portions 24 of mounting bracket 19 in FIG. 2A. Then the front end of the drawer slide is mounted to the cabinet frame at the front. Alignment of the drawer slide is then accomplished by manually moving the rear end of the slide back and forth between end stops 28 of FIG. 2A until the slide is in the relative position desired for alignment of the drawer front with the cabinetry front.

Figure 3A:
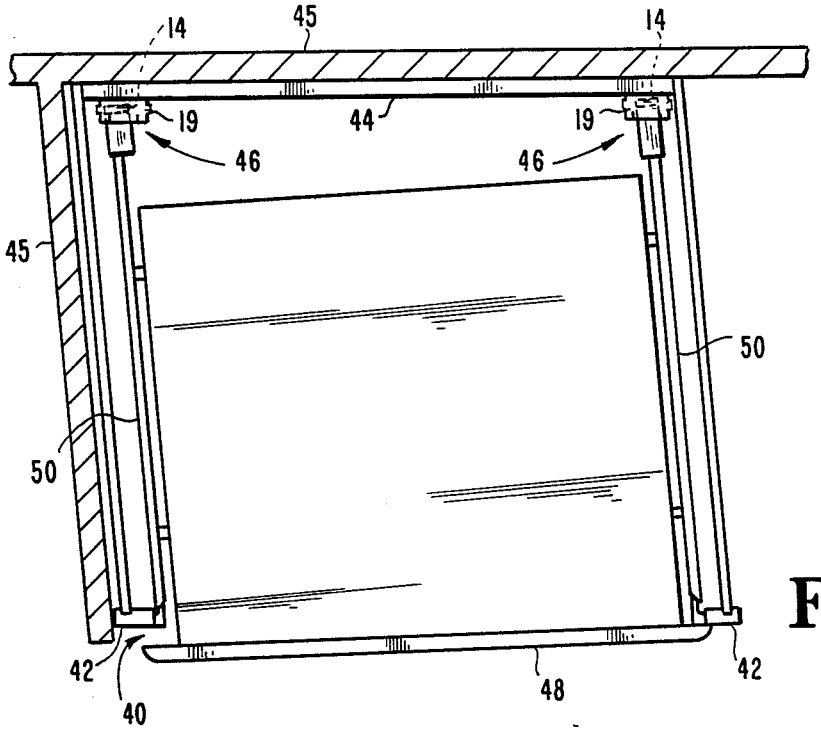
FIG. 3A is a top view of a cabinet frame assembly showing a drawer box mounted to drawer slides and the cabinetry having a non-square installation site with the drawer slides unadjusted.
Figure 3B:
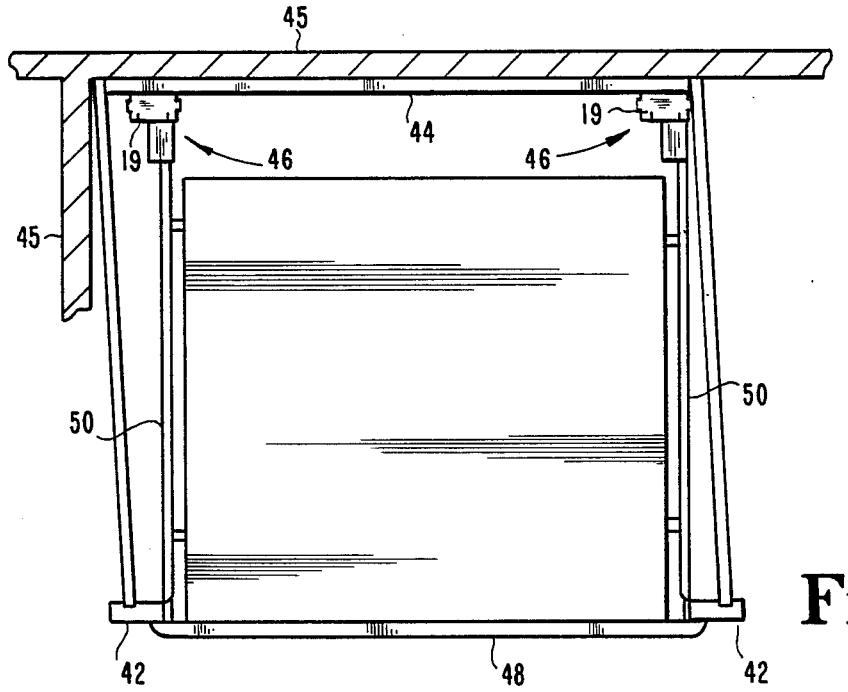
FIG. 3B is a top view of a cabinetry assembly in an unsquare installation site and showing a drawer box, a front and rear wall, and the present invention connected to the drawer slides facilitating the proper alignment of the drawer box.

FIG. 3A depicts the top view of a cabinetry frame installed in an out-of-square building corner 45, for example. The condition is shown exaggerated for ease of illustration. A gap 40 is produced between the cabinet front and the drawer front 48 due to the unsquare relation of the cabinet back 44 with the cabinet front wall 42, resulting from the constraints of the installation site. Adjusting the bracket assemblies 46; by sliding the cylindrical portions 14 to the right in the spring clip brackets 19, will cause the gap 40 to be eliminated by establishing parallelism of the drawer front flange 48 and the cabinet front wall 42. FIG. 3B shows the results of the adjustment of bracket assemblies 46 wherein the drawer front flange 48 and the cabinet front wall 42 are perfectly aligned and no gap exists along the drawer front flange 48 and the cabinetry front wall 42. Drawer slides 50 are moved either individually, or together with the drawer front flange 48 positioned between the slides to move the slides simultaneously to perfect an alignment suitable to overcome the non-squareness of the cabinet frame due to the installation site.

Figure 4B:
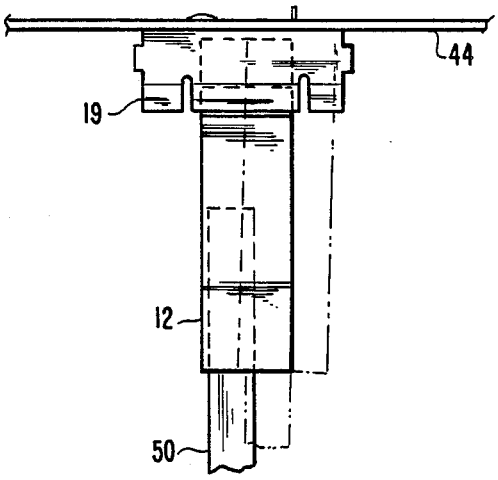
FIG. 4B is a top view of the bracket assembly shown in FIG. 4A illustrating one possible adjustment of the bracket to counteract an unsquare mounting.
Figure 4A:
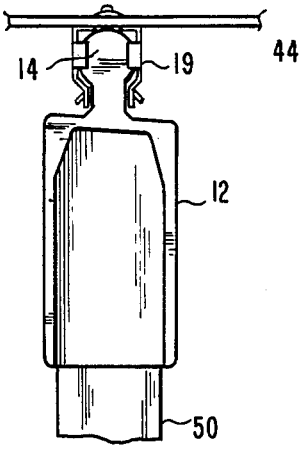
FIG. 4A is side view of the slide bracket assembly according to one embodiment of the present invention.

Referring to FIG. 4A, depicting the bracket assembly rotated 90 degrees from a normal viewing angle for engineering drawing relationship with FIG. 4B. the slide 50 is shown inserted into the slide end bracket 12, and the end bracket cylindrical portion 14 is shown inserted into the mounting bracket 19. The mounting bracket 19 is shown mounted to cabinet back 44. FIG. 4B illustrates in the dashed lines, a lateral adjustment of the end bracket 12 within the mounting bracket 19 as in FIG. 3B, accomplished without the aid of special tools or requiring removal of the bracket assembly and remounting.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A bracket assembly for use in cabinetry as a drawer slide rear mounting and comprising:

a drawer slide end bracket having a first portion with a cylindrical surface having a generally horizontal cylindrical axis, said bracket having a second portion extending generally horizontally from said first portion, said second portion having a height less than the diameter of said cylindrical portion, said bracket also having a slide receiving portion extending generally horizontally from said second portion for receiving a rear end of a drawer slide having a front and a rear end, said slide receiving portion being oriented so that said cylindrical axis is situated transverse to a vertical plane intersecting the front and rear of the drawer slide; and a mounting bracket having a rear surface adapted for mounting to a wall and having an upper surface projecting forward from said rear surface, and said mounting bracket also having a lower surface projecting forward from said rear surface, said upper and said lower surfaces being separated by a distance less than the diameter of said cylindrical surface, and said upper and lower surfaces coacting and comprising clamping means for releasably receiving said first portion of said end bracket.

2. The bracket assembly of claim 1 wherein said upper surface and said lower surface have distal forward edges and said mounting bracket clamping means is comprised of longitudinal detent portions at the distal forward edges of said upper surface and said lower surface for retaining an object between said surfaces.

3. The bracket assembly of claim 2 wherein said longitudinal detent portions of said mounting bracket are centrally located at the forward edges of said upper and said lower surfaces, said detent portions being dimensioned to accept the cylindrical portion of said end bracket, and said mounting bracket also having retaining portions extending downwards near the forward edges of said upper surface and retaining portions extending upwards near the forward edges of said lower surface, said upper and said lower retaining portions located adjacent to said upper and said lower detent portions and defining a gap between said upper and said lower retaining portions dimensioned to allow lateral movement of the second portion of said slide end bracket when said first portion of said end bracket is centrally horizontally inserted between said detent portions and clamped in place by said upper and said lower surfaces.

4. The bracket assembly of claim 3 wherein said lower surface of said mounting bracket has lateral edges and has transverse end stops extending toward the upper surface of said mounting bracket from the lateral edges of said lower surface of said mounting bracket for limiting longitudinal movement of the first portion of said end bracket when said end bracket is releasably clamped within said upper and said lower surfaces of said mounting bracket.

5. The bracket assembly of claim 4 wherein a locating tab projects in a rearward direction from said mounting bracket rear surface and a hole in said rear surface enables attachment of said mounting bracket to a wall.

6. A bracket assembly for use in cabinetry as a drawer slide rear mounting and comprising:

a drawer slide end bracket having a male mounting means for insertion into a mounting receptacle, and a central portion extending generally horizontally from said male means, and said bracket also having a slide receiving portion extending generally horizontally from said central portion for fixedly receiving a rear end of a drawer slide having a front and a rear end; and a mounting bracket having a rear surface adapted for mounting to a wall, female means for slidably and rotatably receiving said male means of said slide end bracket, said mounting bracket also having means for releasably clamping said male means of said end bracket.

* * * * *